US010180694B2

(12) United States Patent
Manohar et al.

(10) Patent No.: US 10,180,694 B2
(45) Date of Patent: Jan. 15, 2019

(54) ADAPTIVE BODY BIAS FOR VOLTAGE REGULATOR

(71) Applicant: TEXAS INSTRUMENTS INCORPORATED, Dallas, TX (US)

(72) Inventors: Sujan Kundapur Manohar, Dallas, TX (US); Angelo William Pereira, Allen, TX (US); Ashish Khandelwal, Irving, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/655,373

(22) Filed: Jul. 20, 2017

(65) Prior Publication Data

US 2018/0284824 A1 Oct. 4, 2018

Related U.S. Application Data

(60) Provisional application No. 62/480,773, filed on Apr. 3, 2017.

(51) Int. Cl.

| | |
|---|---|
| ***G05F 1/575*** | (2006.01) |
| ***G05F 3/26*** | (2006.01) |
| ***G05F 1/46*** | (2006.01) |
| ***G05F 1/567*** | (2006.01) |

(52) U.S. Cl.

CPC ..... *G05F 1/575* (2013.01); *G05F 1/465* (2013.01); *G05F 1/567* (2013.01); *G05F 3/267* (2013.01)

(58) Field of Classification Search

CPC ..... G05F 1/575; G05F 1/567; G05F 3/267; G05F 1/465

See application file for complete search history.

(56) References Cited

U.S. PATENT DOCUMENTS

| | | | | |
|---|---|---|---|---|
| 6,504,424 | B1 | 1/2003 | Heminger et al. | |
| 6,861,832 | B2 | 3/2005 | Perez | |
| 9,299,668 | B2 * | 3/2016 | Bourgeat | H01L 23/60 |
| 9,489,000 | B2 * | 11/2016 | Caffee | G05F 1/575 |

FOREIGN PATENT DOCUMENTS

JP 2016218639 A 12/2016

OTHER PUBLICATIONS

International Search Report for PCT/US2018/025788 dated Aug. 23, 2018; 2 pages.

* cited by examiner

*Primary Examiner* — Jung Kim
(74) *Attorney, Agent, or Firm* — Michael A. Davis, Jr.; Charles A. Brill; Frank D. Cimino

(57) ABSTRACT

A voltage regulator (e.g., a low drop-out regulator) includes a pass transistor coupled to an input voltage node and an output voltage node. The voltage regulator also includes a drive transistor coupled to a control input of the pass transistor and a first resistor coupled between a source and a back gate of the drive transistor. The voltage regulator also includes a complementary to absolute temperature (CTAT) current generator circuit coupled to the resistor and configured to generate a CTAT current to bias the first resistor.

20 Claims, 3 Drawing Sheets

ADAPTIVE BODY BIAS FOR VOLTAGE REGULATOR

RELATED APPLICATIONS

This application claims prior to U.S. Provisional App. No. 62/480,773 titled "Precise Adaptive Body Bias Technique for LDO Regulator and Similar Power Stage Circuits." Filed Apr. 3, 2017 and incorporated herein by reference.

BACKGROUND

A low drop-out (LDO) regulator is a linear regulator which utilizes a transistor to generate a regulated output voltage with a low differential between the input voltage and the output voltage. In battery powered devices, it is common to have a switching regulator, such as a buck regulator, between the battery and an LDO regulator. This circuit arrangement combines the efficiency of a switching regulator and the fast response of a LDO regulator. For further improvements in efficiency, the output voltage from the switching regulator usually is set dose to the desired regulated output voltage from the LDO regulator. The gate-to-source voltage to operate the main power transistor in an LDO regulator is limited by the magnitude of the input voltage to the LDO regulator.

SUMMARY

Some embodiments are directed to a voltage regulator that includes a pass transistor coupled to an input voltage node and an output voltage node. The voltage regulator also includes a drive transistor coupled to a control input of the pass transistor and a first resistor coupled between a source and a back gate of the drive transistor. The voltage regulator also includes a complementary to absolute temperature (CTAT) current generator circuit coupled to the resistor and configured to generate a CTAT current to bias the first resistor.

Another embodiment is directed to a voltage regulator that includes a pass transistor coupled to an input voltage node and an output voltage node. The pass transistor comprises a p-type metal oxide semiconductor field effect transistor (MOSFET) including a gate, a source, a drain, and a back gate. The source is connected to an input voltage node and to the back gate and the drain is connected to an output voltage node. The voltage regulator also includes a drive transistor coupled to gate of the pass transistor and a first resistor connected between a source and a back gate of the drive transistor. A CTAT current generator circuit also is included and is coupled to the resistor. The CTAT current generator circuit is configured to generate a CTAT current that is used to bias the first resistor.

BRIEF DESCRIPTION OF THE DRAWINGS

For a detailed description of various examples, reference will now be made to the accompanying drawings in which.

DETAILED DESCRIPTION

Certain terms are used throughout the following description and claims to refer to particular system components. As one skilled in the art will appreciate, different parties may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct wired or wireless connection. Thus, if a first device couples to a second device, that connection may be through a direct connection or through an indirect connection via other devices and connections. The recitation "based on" is intended to mean "based at least in part on." Therefore, if X is based on Y, X may be a function of Y and any number of other factors.

A voltage regulator, such as a low drop-out (LDO) regulator is described herein that includes a drive transistor that drives a signal to a power transistor. The power transistor provides an output voltage from the voltage regulator to a load. In accordance with the disclosed embodiments, the drive transistor includes a source that is connected to the back gate by way of a resistor. A current flows through the resistor to thereby bias the back gate of the drive transistor. By biasing the drive transistor's back gate, the threshold voltage of the drive transistor can be lowered. Lowering the drive transistor's threshold voltage permits the drive transistor to be turned on with a lower gate-to-source voltage, which thereby permits an increase of load current for the same input voltage to the voltage regulator, increases the available voltage headroom for turning on the power transistor for a given power supply voltage, or which permits the same load current for a smaller input voltage. Further, the potential for a latch-up condition is reduced.

In some embodiments, the current generated within the LDO regulator to bias the drive transistor's back gate is generated by a complementary to absolute temperature (CTAT) current generator. This current generator generates a CTAT current, that is, a current that varies inversely with temperature. The drive transistor may comprise a p-type metal oxide semiconductor field effect transistor (PMOS), and the threshold voltage of the PMOS varies inversely with temperature. Because a CTAT current is used to bias the drive transistor's back gate and the threshold voltage is proportional to the back gate voltage, the threshold voltage and the back gate voltage generally track each other with temperature, that is, vary in the same direction with temperature.

Figure 1:
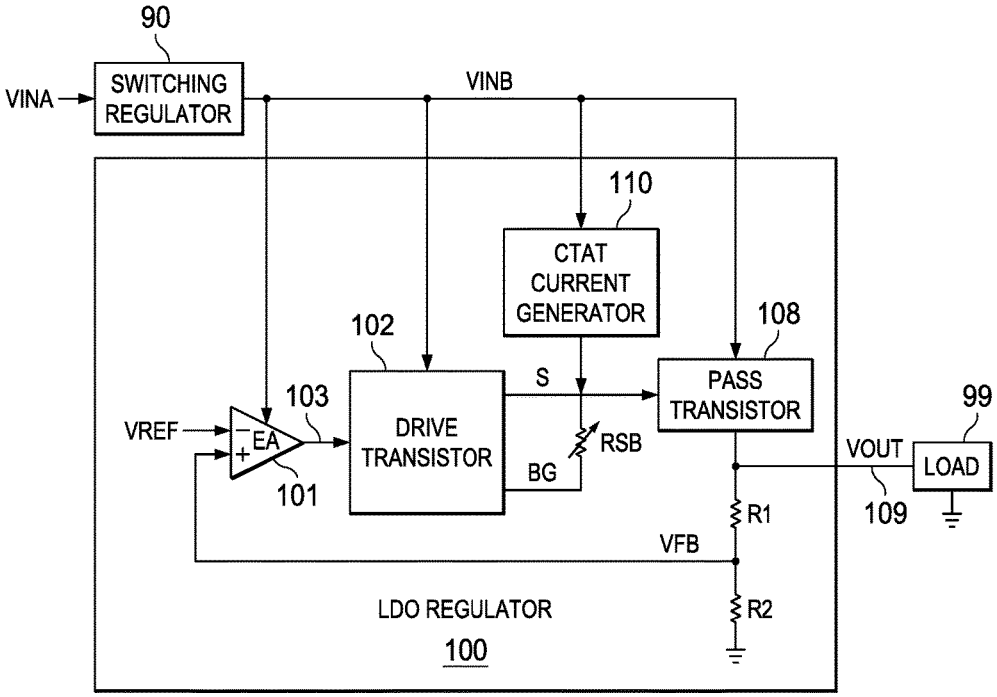
FIG. 1 is a block diagram of a system including a low drop-out regulator in accordance with an example.

FIG. 1 illustrates a system in which a switching regulator 90 is coupled to an LDO regulator 100 (also termed a "voltage regulator") for providing an output voltage (Vout) to a load 99. The output voltage comprises the operating voltage for the load 99. The load 99 may comprise any passive or active electrical circuit or device that performs one or more desired functions. For example, the load 99 may comprise circuitry within a computing device such as notebook computer, tablet device, smart phone, etc. The input voltage to the switching regulator 90 is designated as VINA, and the output voltage from the switching regulator 90 is designated as VINB. In general, VINB is lower than VINA. As a low drop-out regulator, LDO regulator 100 is able to generate a regulated output voltage, Vout, with little headroom between VINB and Vout.

The LDO regulator 100 includes an error amplifier (EA) 101, a drive transistor 102, a pass transistor 108, resistors R1 and R2, and a CTAT current generator 110. The resistors R1 and R2 are connected in series between the output voltage node 109 and ground thereby forming a voltage divider. The connection point between the resistors R1 and R2 provides a scaled down version of Vout and is used as a feedback voltage (VFB) to the error amplifier 101. The error amplifier 101 amplifies the difference between VFB and a reference voltage, VREF. The output signal 103 from the error amplifier 101 is provided to the drive transistor 102 to turn the drive transistor 102 on and off to thereby control the state of the pass transistor 108. Thus, the pass transistor 108 is controlled based on the feedback voltage, VFB, to maintain the output voltage, Vout, on output voltage node 109 at a regulated level.

A resistor is connected between the source (S) and the back gate (BG) of the drive transistor 102. The resistor is designated as RSB, and can be trimmable as indicated by the arrow through the resistor symbol and as explained below. The CTAT current generator 110 generates a current that varies inversely with temperature. The current produced by the CTAT current generator 110 flows through RSB and thus is used to bias the drive transistor's back gate (BG).

Figure 2:
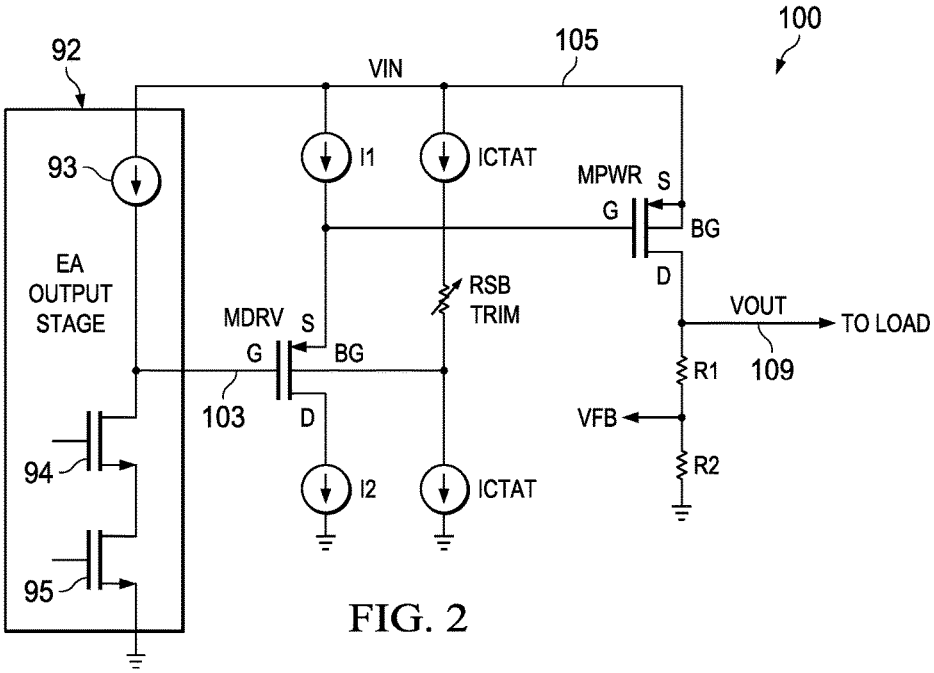
FIG. 2 shows an example implementation of at least a portion of the low drop-out regulator of FIG. 1.

FIG. 2 shows an embodiment of a portion of the LDO regulator 100 coupled to a portion of an output stage 92 of the error amplifier 90. The error amplifier's output stage 92 includes a current source 93 coupled to two transistor switches 94 and 95. The LDO regulator 100 in this embodiment includes the drive transistor MDRV (illustrated as drive transistor 102 in FIG. 1), the pass transistor MPWR (illustrated as pass transistor 108 in FIG. 1), resistors R1, R2, and RSB, current sources I1 and I2, and CTAT current sources (ICTAT). Current sources I1 and I2 may be equal (i.e., same current). In this embodiment, MDRV and MPWR comprise pMOS transistors and each has a gate (G), a source (S), a drain (D), and a back gate (BG). The back gate may also be referred to as a bulk connection. The gates of the transistors represent control inputs for the transistors.

The pass transistor MPWR couples to an input voltage node 105 and the output voltage node 109. In this configuration, the source of the pass transistor MPWR connects to the input voltage node 105 and the drain connects to the output voltage node 109. Further, the back gate of the pass transistor MPWR connects to the source thereby shorting the source to the back gate. The series-connected resistors R1 and R2 connect between the drain of the pass transistor MPWR and ground as shown.

The drive and pass transistors MDRV and MPWR are matched meaning that they are formed from a common semiconductor substrate and process. The drive transistor MDRV may have a physical size that is smaller than the pass transistor MPWR. Transistors MDRV and MPWR may be chosen to be the same transistor component from a library of components. The device sizes expressed in the general form N*(W/L) (where W is width and L is length) are designed such that L_MDRV=L_MPWR and W_MDRV=W_MPWR. The number of fingers are designed such that N_MPWR=K*N_MDRV where K>>1. This choice enables the MDRV transistor device parameters to closely track MPWR device parameters across large sample sizes of integrated circuits and across temperature and semiconductor process variations.

The gate of the drive transistor MDRV is coupled to the error amplifier output stage 92 as shown and receives the output signal 103 from the error amplifier. The current sources I1 and I2 function to drive current through the source to drain channel of the drive transistor MDRV. The source of the drive transistor MDRV connects to the current source I1 and the gate of the pass transistor MPWR.

Resistor RSB couples between the source and the back gate of the drive transistor MDRV. Current flowing through resistor RSB biases the back gate of the drive transistor MDRV relative to the source. For example, the back gate voltage is less than the source voltage due to the voltage drop across resistor RSB. The threshold voltage of the transistor MDRV is a function of the source-to-back gate voltage as is illustrated by the following equation:

$$V_T = V_{FB} - |2\varphi_F| - \frac{\sqrt{2\varepsilon_S q N_d(|2\varphi_F| - V_{SB}}}{C_{ox}}$$

which can be written in a simpler form as:

$$V_T = V_{T0} + \gamma\left(\sqrt{2\phi_F + V_{SB}} - \sqrt{2\phi_F}\right) \text{ where } \gamma \text{ is the body effect parameter}$$

$$\gamma = \frac{\sqrt{2\epsilon_S q N_d}}{C_{ox}}$$

$$V_{T0} \text{ is the } V_T \text{ with } V_{SB} = 0$$

where $V_{FB}$ is the flatband voltage, $2\varphi_F$ is the surface potential, $\varepsilon_S$ is the permittivity of silicon, $N_d$ is the doping concentration, and $C_{ox}$ is the gate oxide concentration. In accordance with the disclosed embodiments, the back gate of the transistor MDRV is biased, which thus reduces the threshold voltage of the transistor.

The current used to bias the back gate through resistor RSB varies inversely with temperature as noted above and is generated by the ICTAT current sources which comprise the CTAT current generator 110 of FIG. 1.

Figure 3:
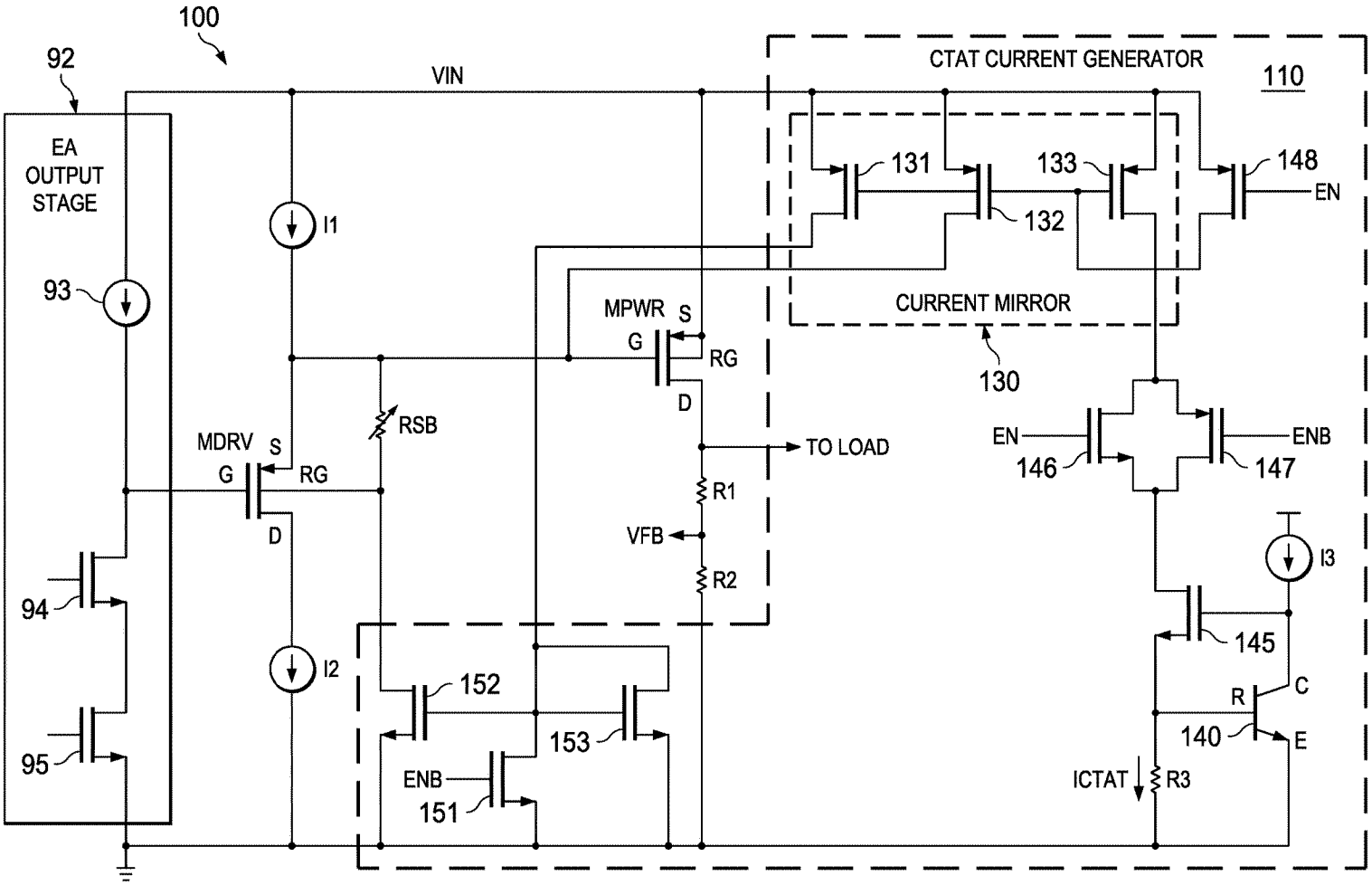
FIG. 3 shows a further example of an implementation of a portion of the low drop-out regulator.

FIG. 3 shows an example of the implementation of the CTAT current generator 110. The CTAT current generator 110 in this example includes a current mirror 130, a bipolar junction transistor (BJT) 140, a resistor R3, transistors 145, 146, 147, 148, 151, 152, and 153, and a current source I3. The BJT includes a base (B), collect (C), and an emitter (E). The BJT 140 provides a voltage produced across a p-n junction comprising the base and emitter. In other embodiments, other types of p-n junctions can be included other than a BJT. Current source I3 produces a current that causes transistor 145 to turn on, thereby causing the BJT to conduct and produce the base-to-emitter voltage. Resistor R3 connects between the base and emitter of the BJT as shown and thus receives the base-to-emitter voltage produced by the BJT 140. As a result, a current flows through resistor R3. The base-to-emitter voltage of the BJT 140 varies inversely with temperature, so the current through R3 also varies inversely with temperature thereby representing the ICTAT current.

The current mirror 130 comprises transistors 131, 132, and 133 mirrors the ICTAT current into resistor RSB. The voltage generated across RSB thus is (VBE/R3)×RSB, where VBE/R3 represents the current through resistor R3. If the resistance values of R3 and RSB are equal, then the source-to-back gate bias voltage across resistor RSB will equal the CTAT base-to-emitter voltage of the BJT 140. In some embodiments, the resistance value of RSB is n/R3, where 0<n<1. As such, the source-to-back gate bias voltage across resistor RSB is less than or equal to the base-to-emitter voltage of the BJT 140 and is related to the base-to-emitter voltage of the BJT 140 by the ratio of RSB to R3. In some embodiments, RSB and R3 are matched meaning that they are (a) fabricated using the same steps or using the same component from a design library, (b) have the same dimensions of width and length, and (c) are closely located and their fingers, if using poly-silicon resistors, are evenly spaced. Based on these characteristics, the resistors RSB and R3 are expected to track each other's resistance value across process and temperature variations such that their ratio RSB/R3 is equal to a design target at all times.

The CTAT current generator in the example of FIG. 3 also includes an enable input. The enable input is provided to a switch to selectively configure the CTAT current generator circuit to be in an active state in which the CTAT current generator circuit provides the CTAT current to resistor RSB or to an inactive state in which CTAT current is not provided to the resistor. That is, the CTAT current generation capability of the LDO regulator can be disabled. For example, for a battery operated device, to save power, it might be desired to disable the CTAT current generation capability of the LDO regulator. The LDO regulator will otherwise continue to operate, but do so without the back gate of the drive transistor MDRV being biased with respect to the source.

In the example of FIG. 3, transistors 146-148 and 151 can be turned on and off by an enable signal (EN) or its complementary signal (ENB). If, for example, EN is high and ENB is low, then transistors 146 and 148 are on and transistors 147 and 151 are off thereby permitting the CTAT current generator to bias the drive transistor's back gate with a CTAT current. On the other hand, if EN is low and ENB is high, then transistors 146 and 148 are off and transistors 147 and 151 are on thereby preventing the CTAT current generator from biasing the drive transistor's back gate with a CTAT current.

Figure 4:
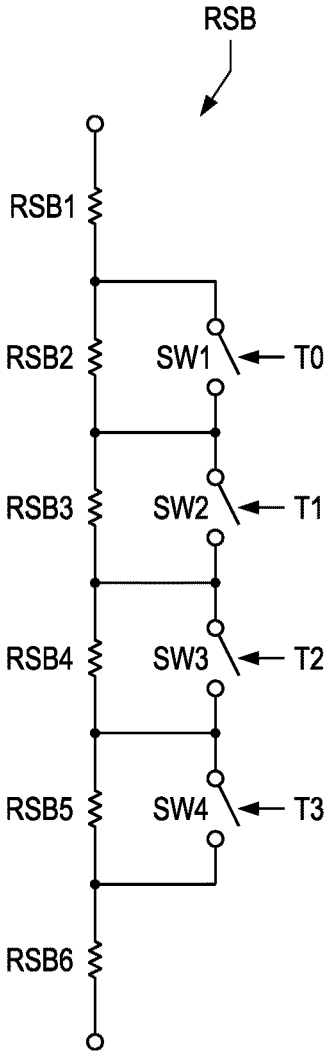
FIG. 4 illustrates trimming a bias resistor in accordance with an example embodiment.

In accordance with some embodiments, resistor RSB is trimmable to provide control over the source-to-back gate voltage of the drive transistor MDRV. RSB can be programmable by fabricating RSB using a series of segments and shorting or opening transistor switches across segments. FIG. 4, for example, illustrates an implementation of resistor RSB as a series of resistors RSB1, RSB2, RSB3, RSB4, RSB5, and RSB6. Resistors RSB1 and RSB6 are always included in the circuit, but resistors RSB2-RSB5 can be individually included or removed from the circuit. A switch across each resistor can be opened or closed by a trim signal. Opening a switch causes the corresponding resistor to be included and closing the switch shorts the resistor. Switch SW1 permits resistor RSB2 to be included or shorted. Switch SW2 permits resistor RSB3 to be included or shorted. Switch SW3 permits resistor RSB4 to be included or shorted. Switch SW4 permits resistor RSB5 to be included or shorted. The trim signals are shown as T0, T1, T2, and T3. The trim signals may be generated upon power up of the LDO regulator 100 based on, in this example, a two-bit trim value stored in a non-volatile memory. With two bits, the trim value can be used to generate four different combinations of trim signals T0-T3 can be generated, with each trim signal being a high or a low signal to open or close the corresponding switch.

The switches can be programmed using a communication interface such as the Inter-Integrated Circuit ($I^2C$) interface or the Serial Peripheral Interface (SPI) in the factory and the optimal settings burned into a non-volatile memory. One trimming method may include:

1. Set trim code of N bit bus to be 0—giving the smallest RSB ($2^{N-1}$ gives the largest RSB)
2. Sweep trim code of N bit bus from 0 to $2^{N-1}$
3. Monitor the voltage VSB of MDRV using existing pins or probe pads on the die
4. Choose the optimal trim code to be one which gives the desired VSB Another indirect trimming method could be as follows:

1. Set trim code of N bit bus to be 0—giving the smallest RSB ($2^{N-1}$ gives the largest RSB)
2. Set the load current of the regulator to, for example, 125% of the rated maximum
3. Monitor the regulator output voltage
4. Sweep trim code of N bit bus from 0 to $2^{N-1}$
5. Choose the trim code to be one which allows the regulator to operate within, for example, −5% of the rated regulator output voltage The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A voltage regulator, comprising:

a pass transistor coupled to an input voltage node and an output voltage node;

a drive transistor coupled to a control input of the pass transistor;

a first resistor coupled between a source and a back gate of the drive transistor; and a complementary to absolute temperature (CTAT) current generator circuit coupled to the resistor and configured to generate a CTAT current to bias the first resistor.

2. The voltage regulator of claim 1, wherein the CTAT generator circuit includes a P-N junction coupled to a second resistor.

3. The voltage regulator of claim 1, wherein the CTAT generator includes a second resistor and a bipolar junction transistor having a base and an emitter, wherein the second resistor is coupled between the base and the emitter.

4. The voltage regulator of claim 3, wherein the CTAT generator includes a current mirror coupled to the second resistor, wherein the current mirror is configured to generate a current through the first resistor that mirrors the current through the second resistor with a scale factor n, where n is between 0 and 1.

5. The voltage regulator of claim 3, wherein the CTAT generator includes a current mirror coupled to the second resistor, wherein the current mirror is configured to generate a current through the first resistor that mirrors the current through the second resistor with a scale factor n, where n is the ratio of the first resistor to the second resistor.

6. The voltage regulator of claim 3, wherein the first and second resistors are matched.

7. The voltage regulator of claim 1 wherein the drive transistor is matched to the pass transistor.

8. The voltage regulator of claim 1, wherein the drive transistor is a p-type metal oxide semiconductor field effect transistor having a threshold voltage that varies inversely with temperature.

9. The voltage regulator of claim 1, wherein the CTAT current generator circuit includes an enable input to a switch to selectively configure the CTAT current generator circuit to an active state in which the CTAT current generator circuit provides the CTAT current to the first resistor or to an inactive state in which CTAT current is not provided to the resistor.

10. A voltage regulator, comprising:

a pass transistor coupled to an input voltage node and an output voltage node, wherein the pass transistor comprises a p-type metal oxide semiconductor field effect transistor (MOSFET) including a gate, a source, a drain, and a back gate, and wherein the source is connected to an input voltage node and to the back gate and the drain is connected to an output voltage node;

a drive transistor coupled to gate of the pass transistor;

a first resistor connected between a source and a back gate of the drive transistor; and a complementary to absolute temperature (CTAT) current generator circuit coupled to the resistor and configured to generate a CTAT current that is used to bias the first resistor.

11. The voltage regulator of claim 10, wherein the CTAT generator includes a second resistor and a bipolar junction transistor having a base and an emitter, wherein the second resistor is connected between the base and the emitter.

12. The voltage regulator of claim 11, wherein the CTAT generator includes a current mirror coupled to the second resistor, wherein the current mirror is configured to generate a current through the first resistor that mirrors the current through the second resistor with a scale factor n, wherein each of the first and second resistors have a resistance value, and wherein n is the ratio of the first resistor's resistance value to the second resistor's resistance value.

13. The voltage regulator of claim 11, wherein the first and second resistors are matched.

14. The voltage regulator of claim 10 wherein the drive transistor and the pass transistor are matched.

15. The voltage regulator of claim 10, wherein the drive transistor is a p-type metal oxide semiconductor field effect transistor having a threshold voltage that varies inversely with temperature.

16. The voltage regulator of claim 10, wherein the CTAT current generator circuit includes an enable input to a switch to selectively configure the CTAT current generator circuit to an active state in which the CTAT current generator circuit provides the CTAT current to the first resistor or to an inactive state in which CTAT current is not provided to the resistor.

17. A voltage regulator, comprising:

a pass transistor coupled to an input voltage node and an output voltage node, wherein the pass transistor comprises a p-type metal oxide semiconductor field effect transistor (MOSFET) including a gate, a source, a drain, and a back gate, and wherein the source is connected to an input voltage node and to the back gate and the drain is connected to an output voltage node;

a drive transistor coupled to gate of the pass transistor; and a first resistor connected between a source and a back gate of the drive transistor.

18. The voltage regulator of claim 17, further including a complementary to absolute temperature (CTAT) current generator circuit coupled to the resistor and configured to generate a CTAT current that is used to bias the first resistor, and wherein the first resistor is trimmable.

19. The voltage regulator of claim 18, wherein the drive transistor is a p-type metal oxide semiconductor field effect transistor having a threshold voltage that varies inversely with temperature.

20. The voltage regulator of claim 18, wherein the CTAT current generator circuit includes an enable input to a switch to selectively configure the CTAT current generator circuit to an active state in which the CTAT current generator circuit provides the CTAT current to the first resistor or to an inactive state in which CTAT current is not provided to the resistor.

* * * * *